US008943866B2

(12) United States Patent
Fernandez et al.

(10) Patent No.: US 8,943,866 B2
(45) Date of Patent: Feb. 3, 2015

(54) MAGAZINE LOCK AND BREECH BLOCK

(71) Applicants: Rick Fernandez, Atascadero, CA (US); James Bentley, Eagle, ID (US)

(72) Inventors: Rick Fernandez, Atascadero, CA (US); James Bentley, Eagle, ID (US)

(73) Assignee: Precision Tactical Inc., Atascadero, CA (US)

( * ) Notice: Subject to any disclaimer, the term of this patent is extended or adjusted under 35 U.S.C. 154(b) by 89 days.

(21) Appl. No.: 13/706,773

(22) Filed: Dec. 6, 2012

(65) Prior Publication Data

US 2014/0165439 A1 Jun. 19, 2014

Related U.S. Application Data

(60) Provisional application No. 61/568,145, filed on Dec. 7, 2011.

(51) Int. Cl.

| | |
|---|---|
| ***F16B 41/00*** | (2006.01) |
| ***F41A 9/00*** | (2006.01) |
| ***F41A 17/38*** | (2006.01) |
| ***F41A 17/42*** | (2006.01) |
| ***F41A 17/44*** | (2006.01) |
| *F41A 17/02* | (2006.01) |

(52) U.S. Cl.

CPC . *F41A 9/00* (2013.01); *F41A 17/38* (2013.01); *F41A 17/42* (2013.01); *F41A 17/44* (2013.01); *F41A 17/02* (2013.01)

USPC ..... 70/232; 70/491; 42/49.01; 42/70.11

(58) Field of Classification Search

USPC ..... 70/232, 491; 49/49.01, 70.11; 42/49.01, 42/70.11

See application file for complete search history.

(56) References Cited

U.S. PATENT DOCUMENTS

| | | | | |
|---|---|---|---|---|
| 3,978,698 | A * | 9/1976 | Ono | 70/165 |
| 4,290,283 | A * | 9/1981 | Labrecque | 70/167 |
| 4,336,698 | A * | 6/1982 | Hurd | 70/231 |
| 4,619,122 | A * | 10/1986 | Simpson | 70/34 |
| 4,726,136 | A * | 2/1988 | Dornaus et al. | 42/70.08 |
| 5,024,072 | A * | 6/1991 | Lee | 70/491 |
| 5,097,686 | A * | 3/1992 | Plumer | 70/232 |
| 5,402,660 | A * | 4/1995 | Osada | 70/491 |
| 5,519,954 | A * | 5/1996 | Garrett | 42/6 |
| 5,581,927 | A * | 12/1996 | Meller | 42/70.11 |
| 5,960,653 | A * | 10/1999 | DeWalch et al. | 70/164 |
| 6,038,898 | A * | 3/2000 | Cliff | 70/491 |
| 6,543,170 | B2 * | 4/2003 | Beretta | 42/70.08 |
| 6,644,078 | B1 * | 11/2003 | Hung | 70/491 |
| 7,076,977 | B2 * | 7/2006 | Lee | 70/58 |
| 7,296,446 | B1 * | 11/2007 | Miao | 70/14 |
| 8,112,926 | B2 * | 2/2012 | Gussalli Beretta | 42/7 |
| 8,661,722 | B2 * | 3/2014 | Dionne et al. | 42/70.11 |
| 8,713,832 | B2 * | 5/2014 | Troy et al. | 42/6 |
| 2003/0226385 | A1 * | 12/2003 | Chin-Shen | 70/491 |
| 2005/0257584 | A1 * | 11/2005 | Tseng | 70/491 |
| 2006/0096344 | A1 * | 5/2006 | Lee | 70/491 |
| 2006/0123683 | A1 * | 6/2006 | Garrett et al. | 42/6 |
| 2013/0111796 | A1 * | 5/2013 | Dionne et al. | 42/70.11 |
| 2013/0227869 | A1 * | 9/2013 | Thordsen | 42/6 |

* cited by examiner

*Primary Examiner* — Suzanne Barrett

(74) *Attorney, Agent, or Firm* — Parsons Behle & Latimer

(57) ABSTRACT

A magazine lock for a firearm includes a magazine well and a magazine latch. The lock includes a tube nut positioned within a housing. The tube nut is connected to the magazine latch of the firearm. When tightened down, the tube nut prevents the magazine latch from releasing a magazine from the magazine well. A tool is provided to engage the tube nut and rotate the tube nut within the housing permitting the magazine latch to release the magazine. The housing includes a biased engagement feature that selectively prevents the rotation of the tube nut within the housing. The tool is configured to overcome the biased engagement feature and to engage the tube nut so that rotation of the tool rotates the tube nut. A breech block inserted into the top of a magazine inserted into the firearm may also be used to lock the firearm.

5 Claims, 8 Drawing Sheets

MAGAZINE LOCK AND BREECH BLOCK

BACKGROUND

1. Field of the Disclosure

The present disclosure generally relates to devices for selectively locking and releasing a magazine of an automatic or semiautomatic firearm, and to devices for holding the breech of a firearm in an open, blocked position for safety purposes.

2. Description of the Related Art

Firearm manufacturers are working to comply with the California Penal Code, Chapter 12.8 in regards to the Department of Justice position on assault weapons. Specifically, Article 2-978.20 (a) states that a "detachable magazine" means any "ammunition feeding device that can be removed readily from the firearm with neither disassembly of the firearm action nor use of a tool being required. A bullet or ammunition cartridge is considered a tool."

In order to comply, a release mechanism for a magazine must involve the use of a tool. There are a number of devices that are marketed in California to make the weapons compliant with the above mentioned code. You can simply Google bullet button to see the primary ones selling. The most popular model only requires inserting any device into the center of the magazine catch device installed on the right side of the receiver to allow the operator to remove the magazine. Two others require that in order to drop the magazine, 1) you need to Allen wrench using nothing other than industry standard Allen wrenches to unscrew a set screw, thereby allowing for the removal of the magazine, 2) the other requires a simple small bladed screw driver or similar device to unscrew its set screw.

In any case, since there is nothing currently available to the public that requires the use of a proprietary tool to manipulate the magazine locking device, the Ca. DOJ will neither accept nor deny these devices are legal to use in the State of California, as it applies to the above mentioned law.

The present disclosure is directed to addressing one or more of the above issues.

SUMMARY

It has been recognized that it would be advantageous to develop a magazine lock device that complies with the California Penal Code and other applicable regulations.

It has also been recognized that it would be advantageous to develop a magazine lock that is easy to use while also complying with the above-mentioned regulations.

It has also been recognized that it would be advantageous to develop a breech block system that can be used to hold open the breech of a firearm.

In accordance with one aspect thereof, the present application discloses a magazine lock for a firearm that includes a magazine latch, associated with a receiver of a firearm, having a socket with a shape, and having a catch that is moveable with respect to a first position in which the catch can extend into a slot of a magazine inserted into the receiver to prevent release of the magazine. A tool is provided, having a shape that matches the shape of the socket, and configured to engage the socket, rotation of the tool in the socket causing the catch to move toward or away from the first position.

In accordance with another aspect thereof, the present application discloses a breech block for a firearm having a barrel with a breech end, a bolt carrier, an upper receiver, a charge handle, a charge handle slot in the upper receiver, and a magazine well for receiving a magazine. The breech block includes a body, insertable into a top of a magazine, and insertable into the magazine well with insertion of the magazine. The body is extendable into the charge handle slot, thereby preventing the charge handle from being pushed to a forward position, and blocking the bolt carrier from feeding into the breech end of the barrel.

One embodiment of the present disclosure is a system for locking a firearm comprising a magazine catch, a tube nut attached to a portion of the magazine catch, a biasing member positioned between the tube nut and the magazine catch, and a housing. The magazine catch is configured to extending into a slot of a magazine inserted into a receiver or a firearm to prevent the release of the magazine from the receiver. The tube nut comprises a first engagement feature. The tube nut is positioned within the housing to secure the housing to the magazine catch. The system includes a tool configured to be inserted into the housing to engage the first engagement feature of the tube nut. Rotation of the tool engages the first engagement feature of the tube nut to rotate the tube nut with the rotation of the tool. The rotation of the tube nut permits the release of the magazine from the receiver.

The tube nut may include a second engagement feature. The housing may include an internal shoulder and a first selectively movable detent on the internal shoulder. The first detent may be biased in an upward position and configured to engage the second engagement feature of the tube nut to prevent rotation of the tube nut when the detent is in the upward position. The tool may be configured to be inserted into the housing to depress the first detent permitting rotation of the tube nut by engagement of the first engagement feature and rotation of the tool.

The tool may comprise an exterior shoulder configured to depress the first detent. The tool may comprise an interior shoulder configured to engage the first engagement feature of the tube nut. The first engagement feature of the tube nut may comprise a plurality of grooves and the tool may include a plurality of projections configured to engage the plurality of grooves. The second engagement feature may comprise a plurality of grooves on a lower shoulder of the tube nut. The housing may include a second selectively movable detent on the internal shoulder that is biased in an upward position. The first and second detents may each be configured to engage one of a plurality of grooves on a lower shoulder of the tube nut when the detents are in the upward position. The detents may selectively prevent the rotation of the tube nut within the housing. The housing may include a plurality of detents located equilaterally around the shoulder configured to engage a plurality of grooves on the tube nut to selectively prevent the rotation of the tube nut within the housing. The system may include a breech block inserted into a top of a magazine inserted into a receiver. A portion of the breech block prevents the movement of the charge handle of the firearm from a rearward position to a forward position preventing the firing of the firearm. A portion of the breech block may extend into a slot in the charge handle.

One embodiment of the present disclosure is a mechanism to selectively lock and release a magazine catch of a fire arm. The mechanism comprises a tube nut having an internally threaded shaft at one end and a projection at the other end. The projection includes an upper external shoulder having at least one first engagement feature and a lower external shoulder that includes at least one second engagement feature. The mechanism includes a housing having a cavity at a first end, an internal shoulder, and an aperture through the internal shoulder that extends to a second end of the housing. The housing includes as least one detent biased in a raised position on the internal shoulder. The tube nut is configured to be positioned within the cavity of the housing with the internally threaded shaft extending into the aperture. When positioned within the cavity of the housing, the lower external shoulder of the tube nut is positioned on the internal shoulder of the housing so that the raised detent engages the at least one second engagement feature selectively preventing the rotation of the tube nut within the cavity of the housing.

The mechanism may further comprise a tool having at least one first mating feature configured to engage the first engagement feature on the upper external shoulder and at least one second mating feature configured to move the at least one detent to a lowered position. The at least one second mating feature of the tool may comprise an external shoulder and the at least one first mating feature of the tool may comprise an internal shoulder. The at least second engagement feature of the tube nut may comprise a plurality of grooves in the lower external shoulder. The at least one first engagement feature of the tube nut may comprise a plurality of grooves in the upper external shoulder. The housing may include at least two detents biased in a raised position on the internal shoulder of the housing.

One embodiment of the present disclosure is a method of unlocking a magazine catch of a firearm receiver. The method comprises inserting a tool between a housing and a tube nut and depressing a biased device that selectively prevents a rotation of the tube nut within the housing. The method further comprises engaging a feature on the tube nut with a portion of the tool while depressing the biased device and rotating the tool while engaging the feature on the tube nut to rotate the tube nut within the housing and moving the magazine catch out of a groove in a magazine positioned within the firearm receiver. The rotation of the tube nut within the housing may permit a biasing member to be depressed permitting the magazine catch to move out of the groove in the magazine.

One embodiment of the present disclosure is a breech block for a firearm receiving having a barrel with a breech end, a bolt carrier, a charge handle having a slot, and magazine well for receiving a magazine. The breech block comprising a body configured to be inserted into a top of a magazine. Then a magazine is inserted into the magazine well of a firearm with the body inserted into the top of the magazine, a portion of the body prevents the charge handle from being moved to a forward position from a rearward position and prevents the bolt carrier from moving into a breech end of the barrel. A portion of the body of the breech block may extend into the slot in the charge handle.

These and other embodiments of the present disclosure will be discussed more fully in the description. The features, functions, and advantages can be achieved independently in various embodiments of the claimed invention, or can be combined in yet other embodiments.

DETAILED DESCRIPTION

Figure 1:
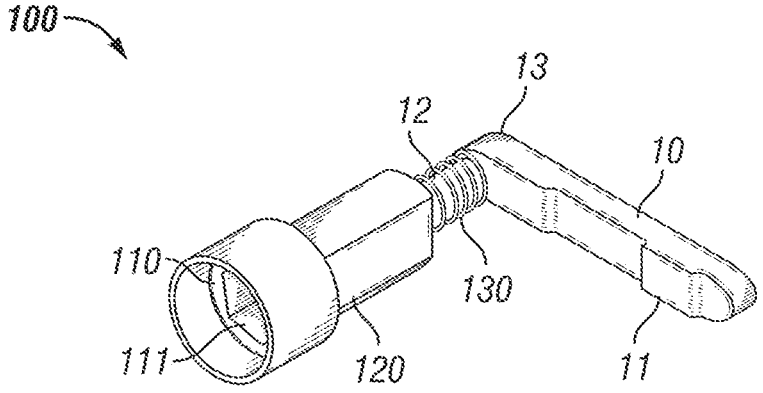
FIG. 1 is a perspective view of an embodiment of a locking mechanism connected to magazine release latch.

Illustrative embodiments are described below as they might be employed in an apparatus for selectively locking a magazine within a magazine well of a firearm receiver and/or locking a charging handle and/or bolt carrier in a rearward non-firing position. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Further aspects and advantages of the various embodiments will become apparent from consideration of the following description and drawings. These embodiments are described in sufficient detail to enable those skilled in the art to practice the invention, and it is to be understood that modifications to the various disclosed embodiments can be made, and other embodiments can be utilized, without departing from the spirit and scope of the present invention. The following detailed description is, therefore, not to be taken in a limiting sense.

As noted above, in order to avoid the inclusion of a "detachable magazine" in a firearm, there is an incentive to design a magazine that requires the use of a tool to release. It is believed that the device disclosed herein is unique in nature by involving the use of a proprietary tool to manipulate the magazine locking device, as disclosed herein.

This device, composed of two parts, is the only one that does in fact require the use of a proprietary tool in order to adjust a tube nut on the magazine catch. Secondly, the coinciding breech block, described later, renders the weapon inoperable.

A selectively locking mechanism prevents the removal of a magazine from a receiver without the use of a tool to selectively unlock the locking mechanism. One embodiment includes an inner tube nut, which may include an engaging shape or feature on its outward face, can only be manipulated by a proprietary tool that has a mirror matching face or engaging feature to engage the tube nut, allowing for the tightening or loosening of the inner nut. Again, once the tool face engages the inner nut face with its unique design, the magazine is then locked into place by screwing down in the tube nut, thereby not allowing the magazine catch to move out of the way of the slot cut into the magazine that is engaged by the magazine release, and not possible to remove with anything other than a device with the exact design and shape of the tube nut that screws down the threads of the magazine catch. This part of the selectively locking system makes it impossible to remove the magazine without the corresponding tool.

An inner breech block installed into a regular magazine inserted into the magazine well of the lower receiver is locked into place with a selectively locking mechanism. When locked, it is impossible to fire a round from the weapon. The breech block when installed into a magazine that is subsequently locked within the receiver, makes the weapon incapable of functioning. The breech block blocks both the bolt carrier and the charging handle from being moved into a forward position. A portion of the breech block may extend up into the charging handle slot cut into the upper receiver. Since the breech block prevents the charging handle from being pushed to its forward position and blocks the bolt carrier from feeding into the locking lugs of the barrel extension, the firearm cannot discharge of a live round of ammunition.

A magazine that includes an inserted breech block that is selectively locked into the receiver may also prevent the circumvention of the magazine lock by scissoring open the upper and lower portions of the receiver. For example, the receiver of an AR-15® firearm includes an upper portion and lower portion that are pinned together. Some safety devices may be circumvented by removal of the rear pin and scissoring open the receiver. The present system locks the weapon and prevents circumvention by scissoring the receiver. The breech block of the system extends into the upper receiver so that the bolt carrier is held back to a point where half of the bolt carrier is in the upper receiver and half of the bolt carrier is the buffer tube of the lower receiver. The extension of the bolt carrier into the buffer tube essentially locks the lower receiver to the upper receiver and a single round may not be inserted into the chamber to be fired without removal of the breech block.

FIG. 1 shows an embodiment of a locking mechanism 100 connected to a magazine latch 10. The locking mechanism 100 comprises a tube nut 110 positioned within a sleeve or housing 120. The tube nut 110 is connected to a portion of the magazine latch 10. The tube nut 110 may be threaded onto a shaft 12 of the magazine latch 10 securing the housing 120 and the tube nut 110 to the magazine latch 10. A biasing member 130, such as a spring, may be positioned between the housing 120 and an elbow 13 of the magazine latch 10. Various biasing members 130 may be used in connection with the locking mechanism 100 as would be appreciated by one of ordinary skill in the art having the benefit of this disclosure. As would be appreciated by one of ordinary skill in the art the magazine latch 10 is used to selectively retain a magazine 20 (shown in FIG. 2) within a receiver 40 (shown in FIG. 2) of a firearm 50 (shown in FIG. 2). A projection 11 on the magazine latch 10 engages a groove 25 (shown in FIG. 3-5) within the magazine 20 to selectively retain the magazine 20 within the receiver 40 of the firearm 50. To release the magazine 20, a spring loaded button is typically pushed moving the projection 11 of the magazine latch 10 away from the magazine groove 25. As discussed in detail below, the locking mechanism 100 may be used to selectively lock down the magazine latch 10 preventing the release of a magazine 20 from the firearm 50. The tube nut 110 may be rotated within the housing 120 to tighten against the receiver 40 of the firearm 50 not permitting the depression of the biasing member 130. When the tube nut 110 is sufficiently tightened, the projection 11 of the magazine latch 10 cannot be moved away from magazine groove 25 to release the magazine 20.

Figure 2:
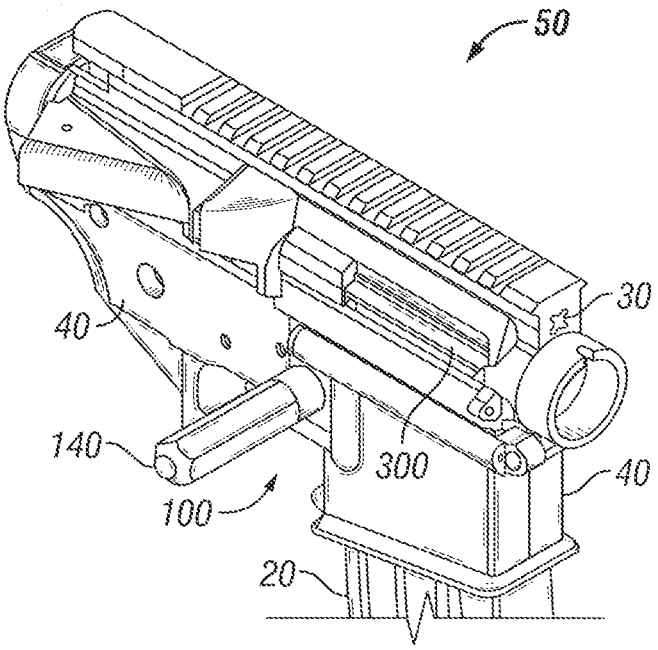
FIG. 2 is a perspective view of the receiver portion of a firearm with a magazine, having the locking mechanism of FIG. 1 installed therein, with a magazine release tool inserted into the locking mechanism.

FIG. 2 shows a portion of a firearm 50 having an upper receiver 30 and a lower receiver 40. A magazine 20 has been inserted into the lower receiver 40. Prior to insertion of the magazine 20 into the lower receiver 40, a breech block 300 has been inserted into the top of the magazine 20. The breech block 300 prevents the firing of a round from the firearm 50 as will be discussed in detail below. A locking mechanism 100 selectively secures the magazine 20 within the lower receiver 40 of the firearm 50. A tool 140 is positioned to mate with the locking mechanism 100. The tool 140 may be rotated to selectively lock or unlock the magazine latch 10 as described in detail herein.

Figure 4:
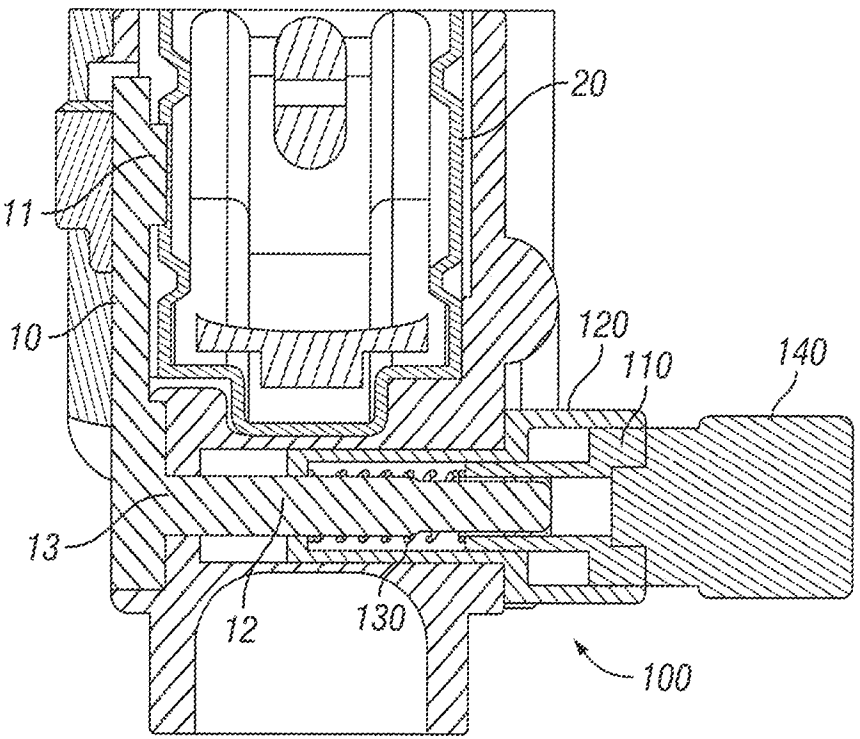
FIG. 4 is a cross section view of a locking mechanism in an unlocked position with the magazine latch securing a magazine within a receiver.
Figure 3:
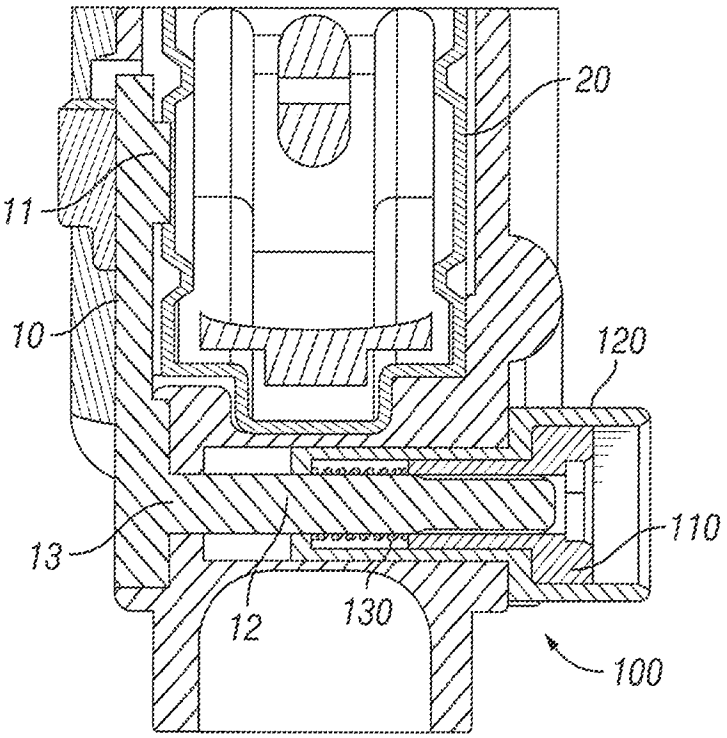
FIG. 3 is a cross section view of a locking mechanism a locked position with a magazine latch securing a magazine within a receiver.
Figure 5:
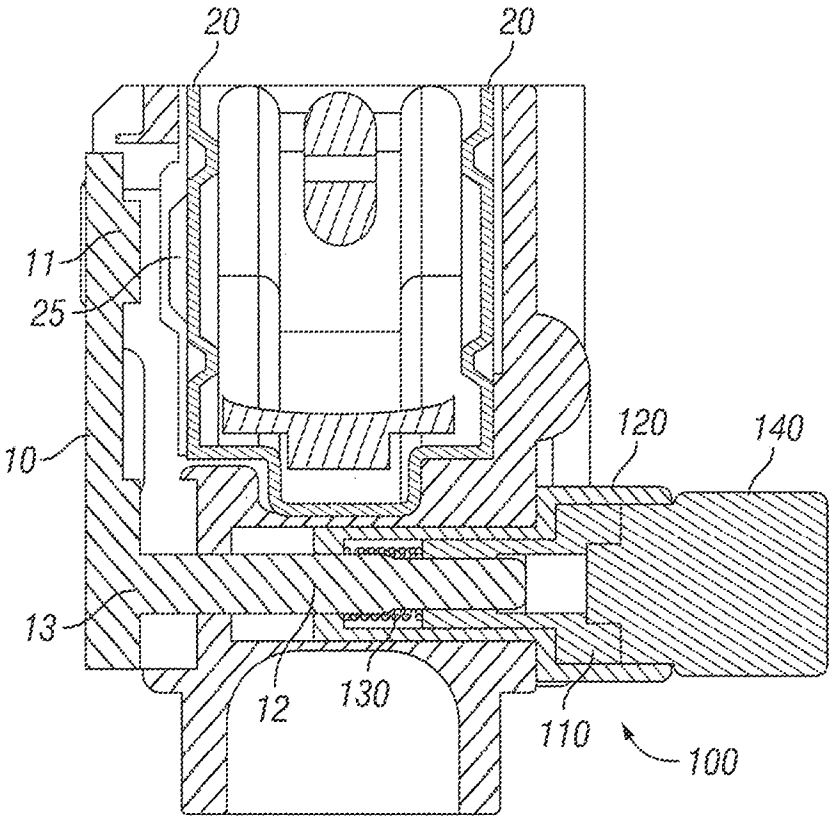
FIG. 5 is a cross section view of a locking mechanism in an unlocked position with the magazine latch moved away from the magazine permitting the removal of the magazine from the receiver.

FIG. 3-5 are cross section views of a portion of lower receiver 40 of a firearm 50 showing the operation of the locking mechanism 100 in connection with the magazine latch 10. FIG. 3 shows the locking mechanism 100 in a locked state so that the protrusion 11 of the magazine latch 11 engages a groove 25 in a magazine 20 inserted into the lower receiver 40. The tube nut 110 is tightened down preventing the actuation or movement of the magazine latch 10 to release the magazine 20. FIG. 4 shows a tool 140 has engaged the tube nut 110 of the lock mechanism 100 to rotate the tube nut 110 within the housing 120. The tube nut 110 has unlocked the locking mechanism permitting movement of the magazine latch 10 away from the magazine, but the tube nut 110 has not been depressed to move the magazine latch 10 away from the magazine groove 25. FIG. 5 shows the depression of the tube nut 110 within the housing 120 to move the projection 11 of the magazine latch 10 away from the groove 25 of the magazine 20. The magazine 20 may then be removed from the lower receiver 40 of the firearm 50.

Figure 6:
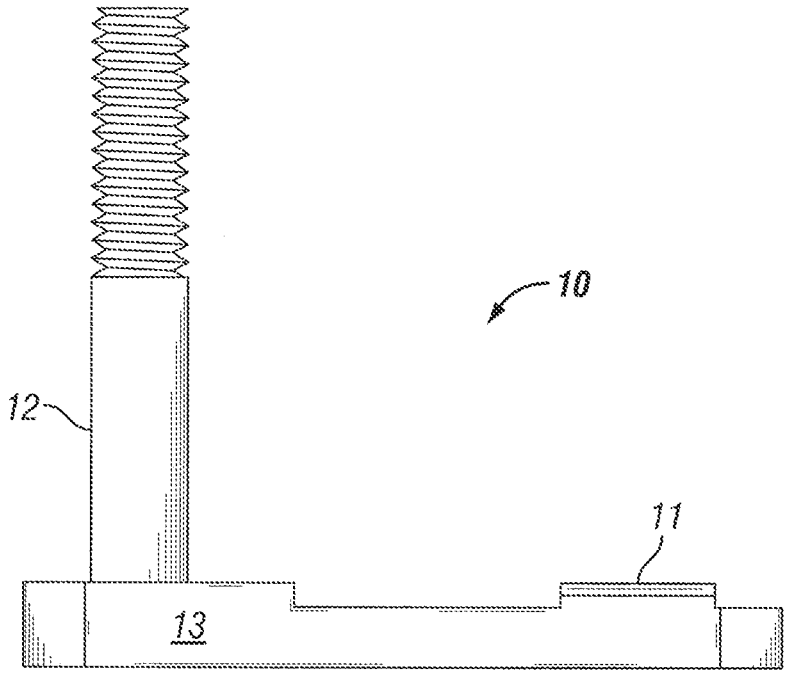
FIG. 6 shows a magazine latch used to selectively secure a firearm magazine with a receiver.

FIG. 6 shows a magazine latch 10 that may be used in connection with the receiver of an AR-15® rifle. The magazine latch 10 includes a projection 11 configured to engage a groove 25 on a magazine 20 to selectively engage the magazine within the receiver 40 of the firearm 50. The magazine latch 10 includes a threaded shaft 12 connected to the latch 10 to form an elbow 13. A release button or locking mechanism 100 may be threaded onto the threaded shaft 12 of the magazine latch 10 as a mechanism to actuate the magazine latch 10 within the receiver of a firearm.

Figure 7:
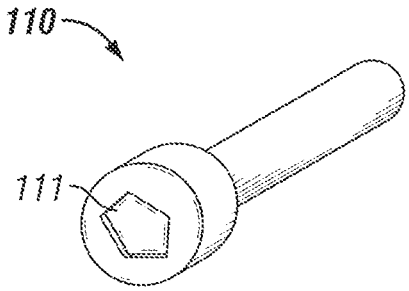
FIG. 7 shows one embodiment of a tube nut of a locking mechanism that may be used to selectively lock a magazine latch in a secured position.

FIG. 7 shows an embodiment of a tube nut 110 that may be used to selectively lock the magazine latch 10 within a receiver 40 of a firearm 50. The tube nut 110 includes a first engagement feature 111 that interfaces or mates with a feature on the tool 140. When the first engagement feature 111 is engaged by a corresponding structure of feature on the tool 140, the rotation of the tool 140 rotates the tube nut 110 within the housing 120 of the locking mechanism 100. The first engagement feature 111 may be a various shapes and configurations that permit the engagement and rotation of the tube nut 110 by the tool 140. For example, the first engagement feature 111 may be a polygonal shape, one or more recesses, one ore more grooves, and/or one or more projections or a combination of these engagement features.

Figure 8:
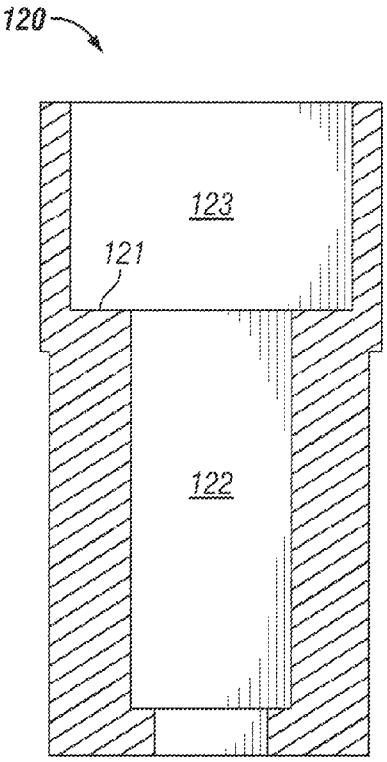
FIG. 8 shows one embodiment of a housing of a locking mechanism that may be used to selectively lock a magazine latch in a secured position.

FIG. 8 shows an embodiment of a sleeve or housing 120 that may be used in conjunction with a tube nut 110 to selectively lock a magazine latch 10 of a firearm 50. The housing 120 includes a cavity 123 at one end with an internal shoulder 121. An aperture 122 extends from the internal shoulder 121 to a second end of the housing 120. The cavity 123 is configured so that the tube nut 110 may be positioned within the housing 120. The aperture 122 permits the connection of the tube nut 110 to a portion of the magazine latch 10. For example, the threaded shank 12 of the magazine latch may be threaded onto a portion of the tube nut 110 in the aperture 122. A portion of the tube nut 110 may rest on the internal shoulder 121 of the housing 120. The internal shoulder 121 may include an anti-rotation device that selectively prevents the rotation of the tube nut 110 within the housing 120 as described below.

Figure 9:
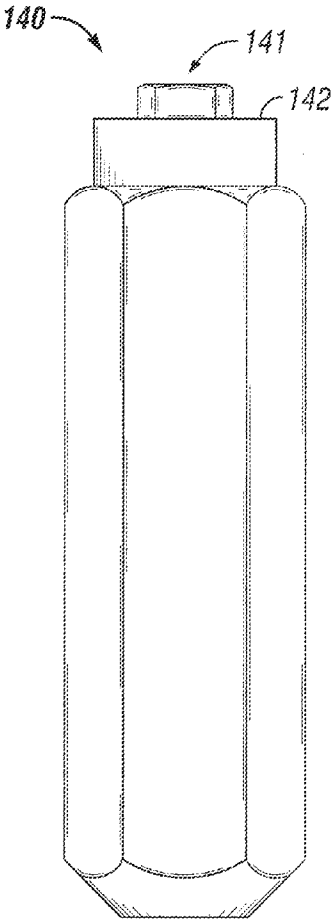
FIG. 9 shows one embodiment of a tool that may be used to selectively unlock a locking mechanism that may be used to selectively lock a magazine latch in a secured position.

FIG. 9 shows an embodiment of a tool 140 used to lock and unlock the locking mechanism 100. The tool 140 includes an engagement feature 141 that is configured to engage the first engagement feature 111 of the tube nut 110 so that rotation of the tool 140 also rotates the tube nut 110 within the housing 120. The tube nut 110 is rotated to selectively lock and unlock the magazine latch 10 within the firearm 50. The tool 140 may include an exterior shoulder 142 used to selectively overcome an anti-rotation device and rotate the tube nut 110 within the housing 120 as described in detail below.

Figure 10:
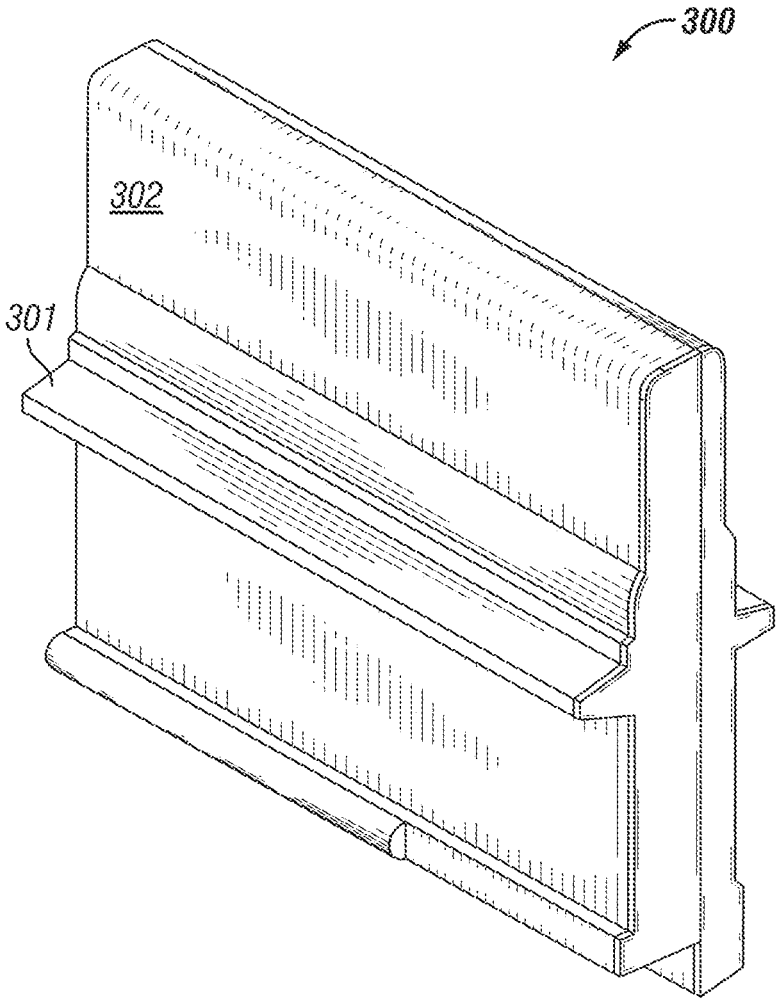
FIG. 10 shows one embodiment of a breech block.
Figure 11:
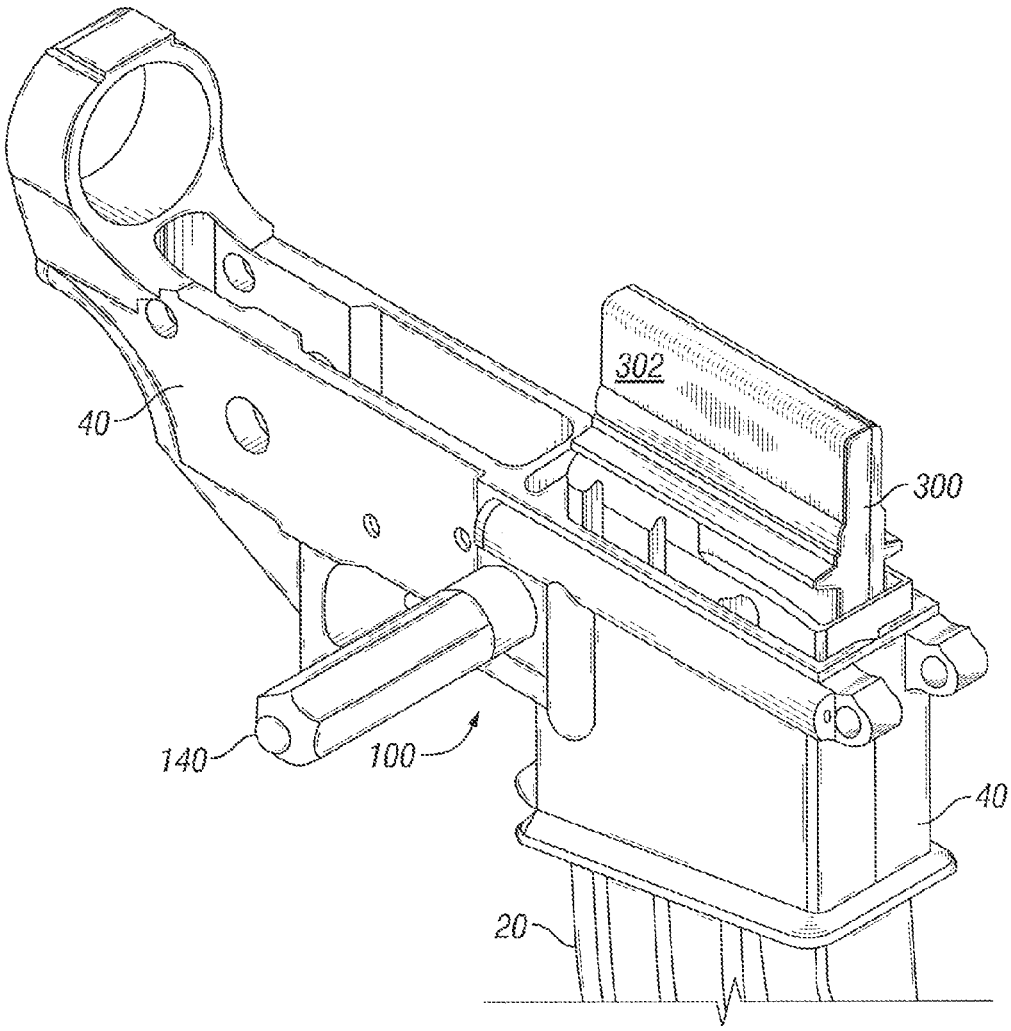
FIG. 11 shows a lower portion of a firearm receiver with a magazine inserted into the magazine well of the receiver, the magazine including a breech block inserted into the top of the magazine.

FIG. 10 shows one embodiment of a breech block 300 that may be used to prevent the firing of a live round from the firearm 50. The breech block 300 includes a retention feature 301 that enables the breech block to be inserted and retained in the top of a magazine 20. The magazine 20 may then be inserted into the receiver of a firearm 50. The breech block 300 includes an upper portion 302 that extends into a portion of an upper receiver 30 preventing the forward movement of a charging handle and/or bolt carrier. FIG. 11 shows a magazine 20 including a breech block 300 inserted into a lower receiver 40 of a firearm 50. A locking mechanism 100 is used to selectively lock the magazine 20 within the lower receiver 40 of the firearm 50. A tool 140 is required to lock and unlock the locking mechanism 100.

Figure 12:
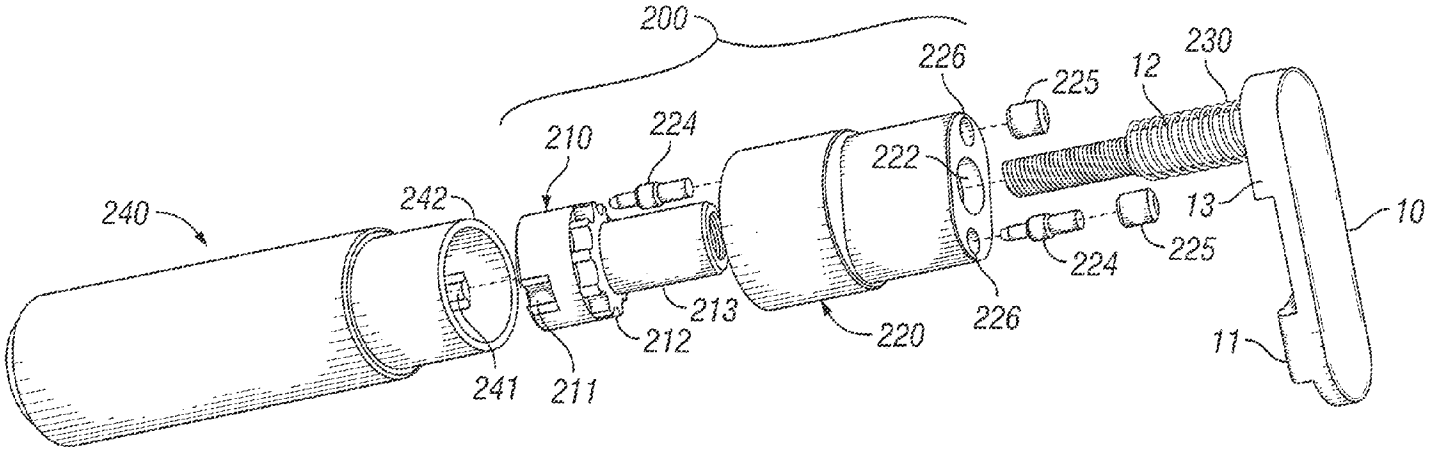
FIG. 12 shows an exploded view of one embodiment of a locking mechanism that may be used to selectively lock a magazine within a receiver of a firearm.

FIG. 12 shows an embodiment of a locking mechanism 200 that may be used to selectively lock a magazine latch 10 preventing the release of a magazine 20 from a firearm 50. The locking mechanism 200 includes a tube nut 210 that is positioned within a cavity 223 of a sleeve or housing 220. The tube nut 210 includes a first engagement feature 211 on an upper shoulder and a second engagement feature 212 on a lower shoulder. The lower shoulder is positioned adjacent and/or against an internal shoulder 221 of the housing 220. A shaft 213 of the tube nut 210 extends through an aperture 222 in the internal shoulder 221 of the housing 220. The shaft 213 includes internal threads 214 and may be threaded onto a threaded shaft 12 of a magazine latch 10. A biasing member 230, such as spring, is positioned on the exterior of the threaded shaft 12 so that the biasing member 230 is between the exterior of the housing 220 and an elbow 13 of the magazine latch 10.

The housing 220 includes one or more detents 224 positioned around the internal shoulder 221 of the housing 220. The detents 224 may be inserted into the housing 220 through holes 226 in the end of the housing 220. Plugs 225 may be used to fill the holes 226 and prevent the detents 224 from being pushed out of the housing by tool 240. The detents 224 are biased to be in an upward position extending above the internal shoulder 221 of the housing 220. The detents 224 may be spring loaded. While in the upward or raised position, the detents 224 are configured to engage the second engagement feature 212 on the lower shoulder of the tube nut 210 to selectively prevent the rotation of the tube nut 210 within the housing 220. The second engagement feature 212 may be a plurality of grooves or recesses in the shoulder of the tube nut 210. The detent 224 may engage a single recess or groove selectively preventing the rotation of the tube nut 210 within the housing 220 while the detent 224 remains in the raised or upward position.

The detents 224 may be pushed into a recessed or lower position by an engagement feature 242 of the tool 240. The detents 224 may be spring loaded and an exterior shoulder 242 may be configured to depress the detents 224 when the tool 240 is inserted between the housing 220 and the tube nut 210. While the detents 224 are depressed the tube nut 210 may be free to rotate within the housing 220. Various anti-rotation devices may be used to selectively prevent the rotation of the tube nut 210 within the housing 220. The housing 220 may include a plurality of anti-rotation devices 224 positioned equilaterally around the interior shoulder 221 of the housing 220.

The tool 240 includes a first mating feature 241 that is configured to engage a first engagement feature 211 on an upper shoulder of the tube nut 210. The first engagement feature 211 of the tube nut 210 may be a plurality of grooves and the first mating feature 241 of the tool 240 may be a plurality of projections. The engagement of the first engagement feature 211 by the first mating feature 241 permits the rotation of the tube nut 210 by the rotation of the tool 240. The rotation of the tube nut 210 within the housing 220 is used to selectively lock or unlock the magazine latch 10 within a firearm 50. The tube nut 210 is tightened down against the magazine latch 10 preventing the movement of the magazine latch 10 away from a magazine 20 preventing the release of the magazine 20 from the firearm 50. The tube nut 210 may be rotated in the other direction until the magazine latch 10 may be pushed away from the magazine 20 removing the projection 11 from the groove 25 in the magazine permitting the magazine 20 to be released from the firearm 50. The shape, number, and configuration of the first engagement feature 211, second engagement feature 212, first mating feature 241, and engagement feature 242 are for illustrative purposes only as various shapes, projections, grooves, and/or recesses may be used to selectively rotate the tube nut 210 with the tool 240 as would be appreciated by one of ordinary skill in the art having the benefit of this disclosure.

Figure 13:
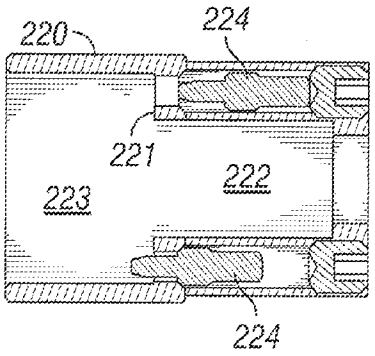
FIG. 13 is a cross section view of the housing shown in FIG. 12.

FIG. 13 shows a cross section of the housing 220 shown in FIG. 12. The housing 220 includes a cavity 223 in which the tube nut 210 is positioned to rest upon or engage an internal shoulder 221. An aperture 222 extends from the internal shoulder 221 out the other end of the housing. The internally threaded shaft 213 of the tube nut 210 may extend into the aperture 222. The threaded shaft 12 of the magazine latch 10 may be threaded into the tube nut 210 in the aperture 222 of the housing 220. FIG. 13 shows on detent 224 in the raised or upper position and one detent 224 in a retracted or lower position. The detents 224 are biased in the raised or upper position to engage the engagement feature 212 of the tube nut 210.

Figure 14:
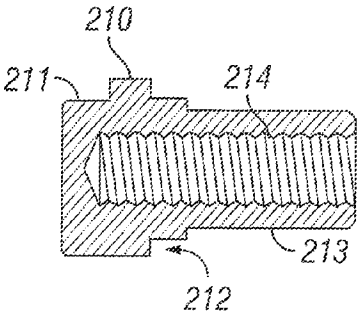
FIG. 14 is a cross section view of the tube nut shown in FIG. 12.

FIG. 14 shows a cross section of the tube nut 210 shown in FIG. 12. The tube nut 210 includes a first engagement feature 211 on an upper exterior shoulder and a second engagement feature 212 on a lower exterior shoulder. The projection 213 of the tube nut 210 includes internal threads 214, which permits the tube nut 210 to be threaded onto the threaded shaft 12 of the magazine latch 10.

Although this disclosure has been described in terms of certain embodiments, other embodiments that are apparent to those of ordinary skill in the art, including embodiments that do not provide all of the features and advantages set forth herein, are also within the scope of this invention. Accordingly, the scope of the present disclosure is defined only by reference to the appended claims and equivalents thereof.

TABLE OF REFERENCE NUMERALS FOR FIGS. 1-14

| | |
|---|---|
| 10 | magazine latch |
| 11 | projection on magazine latch |
| 12 | threaded shaft on magazine latch |
| 13 | elbow of magazine latch |
| 20 | magazine |
| 25 | slot in magazine |
| 30 | upper receiver |
| 40 | lower receiver |
| 50 | firearm |
| 100 | magazine locking mechanism |
| 110 | tube nut |
| 111 | first engagement feature |
| 120 | housing |
| 121 | internal shoulder of housing |
| 122 | aperture |
| 123 | cavity of housing |
| 130 | biasing member |
| 140 | tool |
| 141 | engaging feature of tool |
| 142 | exterior shoulder |
| 200 | magazine locking mechanism |
| 210 | tube nut |
| 211 | first engagement feature |
| 212 | second engagement feature |
| 213 | shaft |
| 214 | threads in shaft |
| 220 | housing |
| 221 | internal shoulder of housing |
| 222 | aperture |
| 223 | cavity of housing |
| 224 | detent |
| 225 | plug |
| 226 | hole in housing for detent |
| 230 | biasing member |
| 240 | tool |
| 241 | first mating feature |
| 242 | exterior shoulder/engagement feature |
| 300 | breech block |
| 301 | retaining feature on breech block |
| 302 | blocking portion on breech block |

What is claimed is:

1. A lock and release mechanism comprising:

a tube nut having an internally threaded shaft at one end and a projection at the other end, the projection including an upper external shoulder that includes at least one first engagement feature and including a lower external shoulder that includes at least one second engagement feature;

a housing having a cavity at a first end, an internal shoulder, and an aperture though the internal shoulder that extends to a second end of the housing, the housing including at least one detent biased in a raised position on the internal shoulder, the tube nut configured to be positioned within the cavity of the housing with the internally threaded shaft extended into the aperture through the internal shoulder;

wherein when the lower external shoulder of the tube nut is positioned on the internal shoulder of the housing the detent in the raised position engages the at least one second engagement feature of the tube nut to prevent rotation of the tube nut within the cavity of the housing; and a tool having at least one first mating feature configured to engage the first engagement feature on the upper external shoulder and at least one second mating feature configured to move the at least one detent to a lowered position.

2. The mechanism of claim 1, wherein the at least one second mating feature of the tool comprises an external shoulder and the at least one first mating feature of the tool is an internal shoulder.

3. The mechanism of claim 1, wherein the at least one first engagement feature comprises a plurality of grooves in the upper external shoulder.

4. A lock and release mechanism comprising:

a tube nut having an internally threaded shaft at one end and a projection at the other end, the projection including an upper external shoulder that includes at least one first engagement feature and including a lower external shoulder that includes at least one second engagement feature;

a housing having a cavity at a first end, an internal shoulder, and an aperture though the internal shoulder that extends to a second end of the housing, the housing including at least one detent biased in a raised position on the internal shoulder, the tube nut configured to be positioned within the cavity of the housing with the internally threaded shaft extended into the aperture through the internal shoulder;

wherein when the lower external shoulder of the tube nut is positioned on the internal shoulder of the housing the detent in the raised position engages the at least one second engagement feature of the tube nut to prevent rotation of the tube nut within the cavity of the housing; and wherein the at least one second engagement feature of the tube nut comprises a plurality of grooves in the lower external shoulder.

5. A lock and release mechanism comprising:

a tube nut having an internally threaded shaft at one end and a projection at the other end, the projection including an upper external shoulder that includes at least one first engagement feature and including a lower external shoulder that includes at least one second engagement feature;

a housing having a cavity at a first end, an internal shoulder, and an aperture though the internal shoulder that extends to a second end of the housing, the housing including at least one detent biased in a raised position on the internal shoulder, the tube nut configured to be positioned within the cavity of the housing with the internally threaded shaft extended into the aperture through the internal shoulder;

wherein when the lower external shoulder of the tube nut is positioned on the internal shoulder of the housing the detent in the raised position engages the at least one second engagement feature of the tube nut to prevent rotation of the tube nut within the cavity of the housing; and wherein the housing includes at least two detents biased in a raised position on the internal shoulder of the housing.

* * * * *